United States Patent [19]

Martushev

[11] 4,273,058

[45] Jun. 16, 1981

[54] EMBROIDERY NEEDLE ASSEMBLY

[76] Inventor: Daniel Martushev, 14874 SE. Taylor Ct., Portland, Oreg. 97233

[21] Appl. No.: 16,370

[22] Filed: Mar. 1, 1979

[51] Int. Cl.[3] ..... D05C 15/06

[52] U.S. Cl. ..... 112/80; 112/222; 223/102

[58] Field of Search ..... 112/48, 78, 222, 169, 112/80; 66/116, 117, 1.5, 2; 128/339, 340; 223/102, 104; 69/20; 12/103; 145/64; 279/104, 46

[56] References Cited

U.S. PATENT DOCUMENTS

| | | | |
|---|---|---|---|
| 908,708 | 1/1909 | Stewart | 223/104 |
| 1,176,032 | 3/1916 | Cole | 112/80 |
| 1,236,258 | 8/1917 | Brown | 112/80 |
| 1,373,059 | 3/1921 | Dubin | 112/80 |
| 1,374,409 | 4/1921 | Valentine | 112/80 |
| 1,998,418 | 4/1935 | Fridolph | 223/102 |
| 2,565,135 | 8/1951 | Kittner | 112/80 |
| 2,581,894 | 1/1952 | Wilson | 223/102 |
| 2,845,898 | 8/1958 | Stanek | 279/46 X |
| 3,657,812 | 4/1972 | Lee | 145/64 |
| 3,815,798 | 6/1974 | Lavitch et al. | 223/102 |

FOREIGN PATENT DOCUMENTS

| | | | |
|---|---|---|---|
| 216234 | 5/1924 | United Kingdom | 66/117 |

*Primary Examiner*—Andrew V. Kundrat
*Assistant Examiner*—Andrew M. Falik
*Attorney, Agent, or Firm*—Kerkam, Stowell, Kondracki & Clarke

[57] ABSTRACT

An embroidery needle comprising a hollow handle member within which is received a spring biased push-rod operating member. A push-button is carried at one end of the rod and a clasp is threaded to the other end. The clasp includes expandable spring fingers which close on each other to form a clutch or vise grip on the end of a needle carried thereby. The needle supports one or more boot gauge members for gauging the height of an embroidery loop to be formed. An axial passageway extends through the entire assembly to allow the embroidery thread to be passed therethrough to the eye of the needle.

1 Claim, 3 Drawing Figures

EMBROIDERY NEEDLE ASSEMBLY

BACKGROUND OF THE INVENTION

1. Field of the Invention

The present invention relates to embroidery needles.

2. Description of the Prior Art

Embroidery is the age old art of forming a decoration on an already existant material with needle and thread. Form and shading are expressed by means of stitches and it is essential in embroidery that the stitches must be readily visible. Stitches are never concealed nor disguised. The simplest form of embroidery needles comprise a solid shank with an eye on the end which needle is manipulated by grasping its between the fingers and inserting the needle through the material. For loop work, a hollow needle is used having a tapered end and the eye is located at the tapered end. Various forms of needle construction are known in the prior art and reference may be made to the following U.S. patents which are illustrative of known forms of embroidery needles:

| | | | |
|---|---|---|---|
| 1,371,976 | 1,409,903 | 2,319,942 | 3,954,072 |
| 1,374,409 | 1,428,397 | 2,581,894 | 3,922,982 |
| 1,392,542 | 1,750,226 | 2,586,505 | 3,986,468 |
| 1,407,609 | 1,881,247 | 2,865,543 | 4,015,551 |

The latter patents are, of course, only illustrative of various forms of embroidery needle constructions. Other forms are illustrated in patents classified in Class 112, subclass 78 and 222 and other related areas.

Embroidery is an ancient art. The Chinese claim to have practiced embroidery as far back 300 years B.C. Ancient embroidery customs and traditions are proudly preserved in many countries throughout the world. One of the more famous embroidery handicrafts best known and appreciated is that known as Russian and Rumanian embroidery.

The garments of men, women and children which still practice the "old tradition" are richly embroidered, for the most part, in subdued harmonious blendings of red, yellow and black and gold. Russian embroidery, exquisite in design and workmanship, has been unchanged for centuries, but such embroidery requires painstaking attention to detail to achieve perfect control of stitches. When such artistry is practiced by hand, even the simplest patterns require large amounts of time to complete.

SUMMARY OF THE INVENTION

A primary object of the present invention is to provide an embroidery needle assembly suitable for use in delicate embroidery work, such as Russian embroidery which enables even an unskilled worker to create exquisite embroidery design with a minimum of effort.

Another object of the present invention is to provide an embroidery needle having guide means to control the stitching.

Still another object of the present invention is to provide an embroidery needle formed of a combination of elements including a needle holder assembly having a push-button openable clutch grip which permits rapid substitution of different types and sizes of needles to permit various types of stitching to be obtained.

BRIEF DESCRIPTION OF THE DRAWINGS

The invention is illustrated in the preferred embodiment in the accompanying drawing in which.

DESCRIPTION OF THE PREFERRED EMBODIMENT

Figure 1:
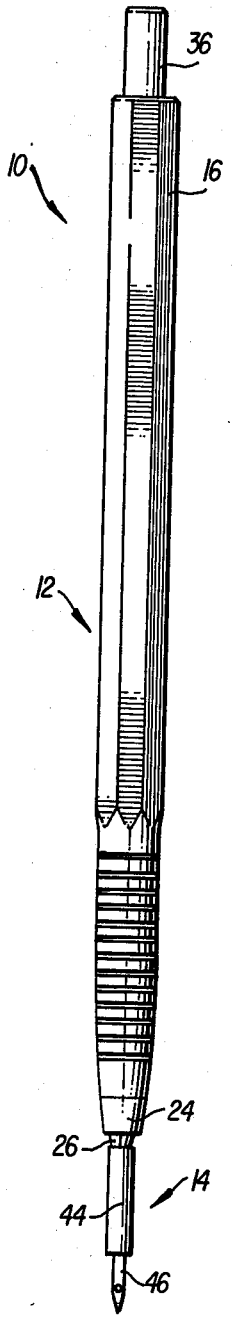
FIG. 1 is an elevational view of the needle assembly of the present invention.
Figure 2:
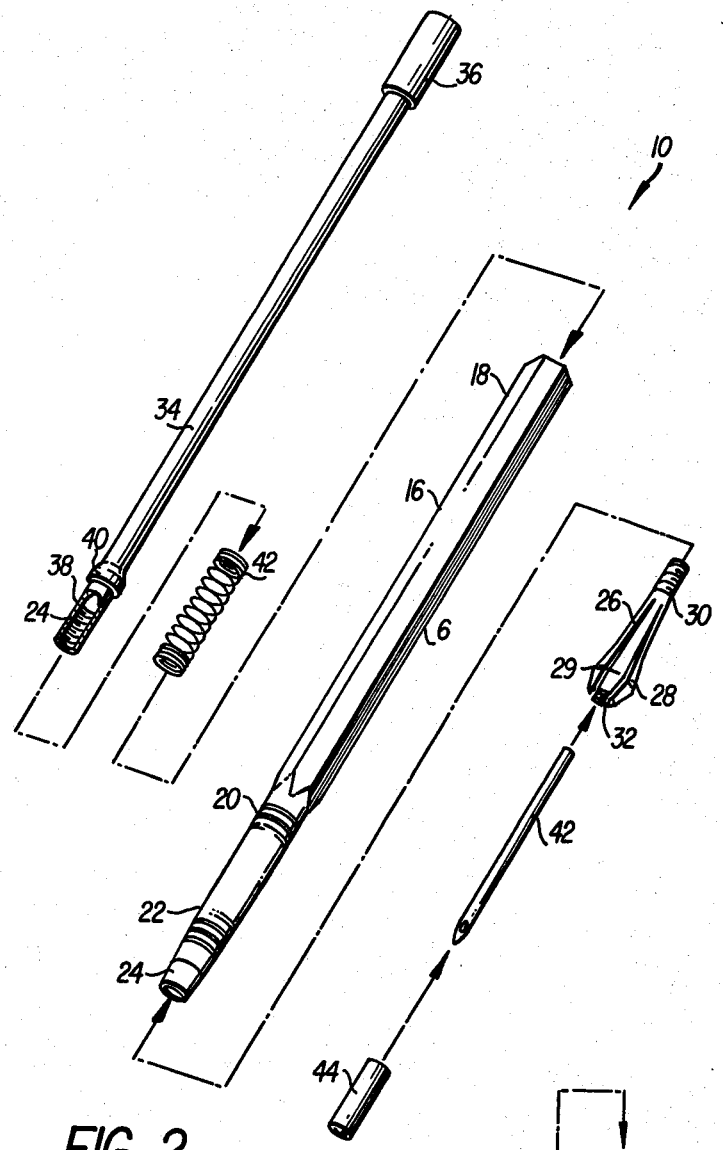
FIG. 2 is an exploded perspective view, partially in cross section, showing the various elements of the needle assembly of FIG. 1.

Referring now to the drawings, and in particular to FIGS. 1 and 2, it will be seen that an embroidery needle assembly 10 in accordance with the present invention is made up of several elements, but generally can be separated into a pen-like handle assembly 12 which includes clutch or grip means for holding one end of a needle assembly 14.

The handle assembly 12 comprises a hollow tubular member 16 which may be any convenient shape in cross section, but which preferably is octagonal in shape along the major portion of its body. In the preferred construction the major upper portion 18 of the handle is of constant cross-sectional hexagonal dimension, while the lower portion 20, that is the end which receives the upper end of needle assembly 14 as viewed in the drawing, has a reducing taper. The outer surface in the area of the reducing taper includes a plurality of spaced annular groves 22 which enable the user to obtain a firm grip on the handle assembly 12. This is particularly advantageous where the user's fingers may be subject to moisture due to perspriation after long periods of use of the device. The grooves serve to minimize slipping. At the very end of the holder there is provided a metal reinforcing member 24 which serves as a seat for a needle clasp for vice grip 26. The clasp 26 is moveable between a first withdrawn position and a second extendable position. When in the withdrawn or normal positon, as shown in FIG. 1, the clasp 26 serves to hold the shank of a needle inserted therein firmly. When the clasp 26 is in the extended position, its fingers 28 expand to release the shank. Member 16 may be fabricated from any suitable material, but to maintain lightness in the device, the handle member is preferably made of plastic.

Needle clasps 26 comprises a spring-type finger gripping vise member having four spring finger elements 28, each of which extend from a externally threaded hollow shaft member 30. Each spring finger is biased to extend or expand away from its major longitudinal axis, such that a slot 32 exists between adjacent fingers in the non-clamping position. In the clamping positon, when the shaft 30 of the clasp is withdrawn into the hollow handle member, the fingers 28 close on each other in vise-like fashion and grip the outer surface of the needle shank as shown in FIG. 1. The interior surface of fingers 28 may be threaded for cooperation with a threaded end of a needle to provide greater stability and gripping action, should that be desired. Generally, however, the gripping action of the needles is sufficient even on a smooth surface needle shank. Knurling or some other surface for increased gripping action may also be provided. Hollow shaft member 30 is threaded on its exterior surface so that it may be conveniently threaded into a hollow push rod 34 contained within hollow tubular member 16 of the handle assembly 12.

As best illustrated in FIG. 2, push rod 34 extends substantially along the entire length of handle 16 and carries at one end a push button member 36. Button member 36 is braced so that it extends beyond the upper end of the handle member 16 as shown in FIG. 1 when in the assembled position. Adjacent the other or lower end 38 of rod 34 there is a swag or annular abutment portion 40. Lower end 38 is received within a biasing spring 42 which has its upper end as viewed in the drawing, seated against the shoulder formed by abutment portion 40. The other end of spring 42 seats against the interior wall of conical portion 20 so as to bias rod 34 outwardly thereof when spring 42 is compressed. The outward extension of rod 34 and its button member 36 is limited by clasp element 26. To this end, fingers 28 in their closed position have an outer dimension which is slightly greater than the opening of the hollow metal reinforcing member 24 and prevents the assembly from being drawn too far inward. Shaft 30 is threaded at its outer surface and threadingly engages cooperating internal threads 38 provided in lower end of rod 34.

In the assembled position, button 36 extends slightly beyond the upper edge of handle 16, such that the clasp 26 is withdrawn into the handle except for its tip portion, as shown in FIG. 1. In this position, the several finger sections close tightly upon each other, providing a vise-like gripping action on the end of the needle assembly 14. Needle assembly 14 includes a hollow needle 42 having one or more stop or boot-like guide members 44 which are slipped or slid over the needle shank. Members 44 snugly fit over the needle and are positoned at a desired height from the tip of the needle to set or gauge the depth of penetration of the needle so as to control loop length of the thread.

Figure 3:
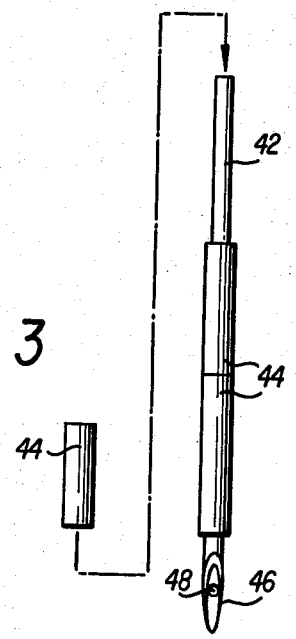
FIG. 3 is an elevational view of a needle having a plastic gauge thereon for controlling the thread loop.

As best shown in FIG. 3, one or more boot members may be positioned at the needle shank, or if desired, a single element **44*a* may be used. The point of the needle may be produced in any well known manner and is preferably cut off at a taper of about 30 degrees at the tip 46. An aperture or eye 48** is provided at the tip through which the thread is passed. As should be apparent, a common coaxial longitudinally extending passage is formed by the various or assembled elements through which the thread passes unimpeded. As will be apparent to those skilled in the art, needles of different taper or different length may be used depending on the nature of the embroidery to be effected.

In the operation of the device, a suitable thread is passed through the hollow button 36 and hollow rod 34 and open spring 42. The thread also passes through the hollow reinforcing member 24 and the shank of the needle and threads through the needle eye 48. At this point, the needle assembly may be separate from the handle member, in which case after threading the needle, the button 36 is depressed to extend clasp 26 outward. Upon this extension, the finger gripping members 28 are open or spread apart to allow the shank of needle 42 to be inserted therein. As pressure on the button 36 is released, the fingers close about the shank of the needle and the clasp is withdrawn into its housing upon return movement of the rod 34 under the force of internal spring 42. The assembly is now ready for embroidering.

The desired plastic gauge is carried by the needle. The gauge is elected in accordance with the desired height of the loop to be formed and should be in place prior to threading the needle. To form a piece of embroidery, the needle is grasped between the fingers, allowing the thread to flow freely over the hand. The needle is inserted, the open side facing in the direction of stitching, the needle always being inserted the full limit into the fabric, i.e. until the boot or gauge 44 presses against the fabric. The needle may be inserted at a right angle (90°) to the fabric or at a slight angle thereto, but preferably should be less than 70° in the direction of stitching. The process is repeated by lifting the needle back to the fabric surface without lifting it off the fabric. The handle is then moved a short distance scratching the needle along the fabric to ensure that it is not lifted above the fabric. After moving the desired distance, the needle is reinserted into the fabric by using gauges of different lengths, loops of different lengths may be formed which, together with the selection of thread color, provides the desired embroidery design. Also, different types of needles for special stitching effect may be substituted by a simple push button action which releases the prior used needle.

I claim:

1. An embroidery needle comprising in combination a handle assembly and a needle assembly, said needle assembly including a hollow needle, said handle assembly including a hollow gripping member, said gripping member having a reducing taper at one end and a plurality of spaced annular peripheral grooves on the taper portion, at least one gauge boot slidingly received over said needle, a hollow push rod disposed within said gripping member and moveable between a first and a second position, said push rod having a swag on its outer surface adjacent one end and an open passage therethrough internally threaded at said one end, helical spring biasing means seated within the reduced taper portion of said gripping member having one end seated in said taper portion and its other end seated against said swag provided on said push rod, said one end of said push rod being disposed within said spring, said helical spring biasing means cooperating with said push rod to exert a biasing force thereon such that one end of said push rod extends outwardly from said gripping member, said push rod also having a hollow push button at its other end for the passage of thread therethrough, clasping means carried at the opposite end of said push rod for clutching said needle assembly, said clasping means having a hollow cylindrical shaft portion including external threads at one end, said clasping means being threaded to said push rod, and said clasping means including a plurality of spring finger gripping elements extending from the other end of said shaft portion and having an expanded position when said push rod is in its first position to allow free insertion between said finger elements of one end of the needle assembly and a closed position when said push rod is in its second position such that said finger elements close tightly about said one end of the needle assembly and a coaxial longitudinally passage extending through said handle assembly and needle assembly.

* * * * *